US006694756B1

(12) United States Patent
Taras et al.

(10) Patent No.: US 6,694,756 B1
(45) Date of Patent: Feb. 24, 2004

(54) SYSTEM AND METHOD FOR MULTI-STAGE DEHUMIDIFICATION

(75) Inventors: Michael F. Taras, Fayetteville, NY (US); Thomas J. Dobmeier, Phoenix, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/307,149

(22) Filed: Nov. 26, 2002

(51) Int. Cl.[7] ..... F25B 29/00
(52) U.S. Cl. ..... 62/173; 62/90
(58) Field of Search ..... 62/173, 176.1, 62/176.5, 176.6, 90, 180, 404; 165/228; 236/44 C

(56) References Cited

U.S. PATENT DOCUMENTS 4,189,929 A * 2/1980 Russell
5,400,607 A * 3/1995 Cayce
5,598,715 A * 2/1997 Edmisten
5,752,389 A * 5/1998 Harper
5,992,160 A * 11/1999 Bussjager et al.
6,055,818 A * 5/2000 Valle et al.
6,131,653 A * 10/2000 Larsson
6,427,454 B1 * 8/2002 West
6,427,461 B1 * 8/2002 Whinery et al.
6,428,608 B1 * 8/2002 Shah et al.

FOREIGN PATENT DOCUMENTS

JP 405201245 A * 8/1993

* cited by examiner

*Primary Examiner*—William E. Tapolcai
*Assistant Examiner*—Mohammad M. Ali
(74) *Attorney, Agent, or Firm*—Bachman & LaPointe

(57) ABSTRACT

A vapor compression system includes at least one vapor compression circuit including a compressor, a condenser, and an expansion device; an evaporator for receiving refrigerant from the vapor compression circuit and adapted to provide a cooled stream of air; an air-reheat heat exchanger positioned to receive the cooled stream of air and communicated with at least one of liquid discharged from the condenser and gas discharged from the compressor or both for reheating the cooled stream of air to a desired temperature; wherein the at least one vapor compression circuit, the evaporator and the air reheat heat exchanger are operable to provide a range of selectable dehumidification rates; and a control system adapted to receive input related to a desired humidity and current humidity-related data and to select an appropriate dehumidification rate from the range based upon the input and the data. A method is also provided.

10 Claims, 4 Drawing Sheets

SYSTEM AND METHOD FOR MULTI-STAGE DEHUMIDIFICATION

BACKGROUND OF THE INVENTION

The invention relates to vapor compression systems and, more particularly, to a system and method for providing improved dehumidification using same.

Current vapor compression systems can provide dehumidification through various schemes which involve cooling the air stream being conditioned beyond a desired temperature so as to remove moisture, and then re-heating the air to the desired temperature. Such systems, however, allow only gross management of the humidity, regardless of whether or not sensible cooling is required, and system efficiency is greatly reduced in either case.

It is clear that the need exists for an improved system and method for dehumidification in vapor compression systems.

It is therefore the primary object of the present invention to provide such a system and method.

It is a further object of the present invention to provide such a system and method which can be readily incorporated into existing vapor compression systems.

Other objects and advantages of the present invention will appear hereinbelow.

SUMMARY OF THE INVENTION

In accordance with the present invention, the foregoing objects and advantages have been readily attained.

According to the invention, a vapor compression system is provided which comprises at least one vapor compression circuit including a compressor, a condenser, and an expansion device; an evaporator for receiving refrigerant from said vapor compression circuit and adapted to provide a cooled stream of air; an air-reheat heat exchanger positioned to receive said cooled stream of air and communicated with at least one of liquid discharged from said condenser and gas discharged from said compressor for reheating said cooled stream of air to a desired temperature; wherein said at least one vapor compression circuit, said evaporator and said air-reheat heat exchanger are operable to provide a range or selectable dehumidification rates; and a control system adapted to receive input related to a desired humidity and current humidity-related data and to select an appropriate dehumidification rate from said range based upon said input and said data.

In further accordance with the present invention, a method is provided for operating a vapor compression system to provide control of dehumidification rate, which method comprises the steps of providing at least one vapor compression circuit including a compressor, a condenser and an expansion device; connecting said at least one vapor compression circuit to an evaporator and an air-reheat heat exchanger so as to provide a range of selectable dehumidification rates for a stream of air passing through said evaporator and said air-reheat heat exchanger; receiving a desired humidity setting; determining an appropriate system dehumidification rate for meeting said desired humidity setting; and adjusting said vapor compression system to provide said appropriate system dehumidification.

BRIEF DESCRIPTION OF THE DRAWINGS

A detailed description of preferred embodiments of the present invention follows, with reference to the attached drawings, wherein.

DETAILED DESCRIPTION

The invention relates to a vapor compression system and, more particularly, to a vapor compression system including a plurality of vapor compression circuits and/or components operable at different speeds and capacities, and further to the control of dehumidification rate based upon selective incorporation of one or more of the multiple vapor compression circuits and/or control of such components for the purposes of dehumidification.

Figure 1:
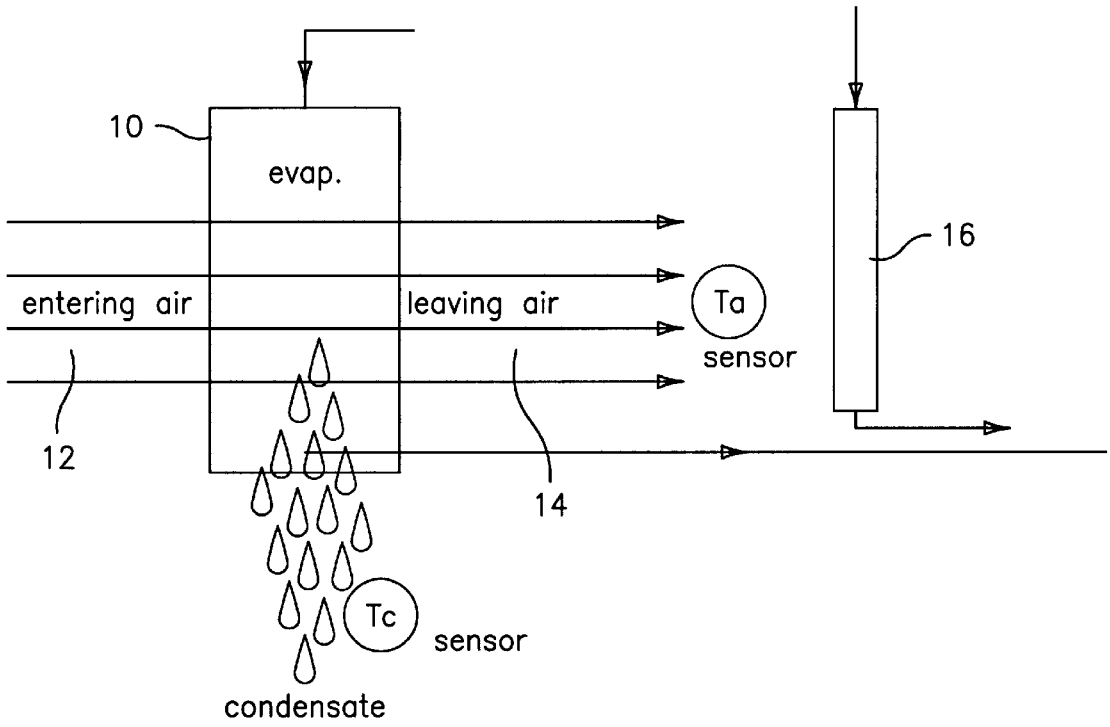
FIG. 1 schematically illustrates a portion of a vapor compression system including multi-stage humidity control in accordance with the present invention.

FIG. 1 schematically illustrates a portion of a vapor compression system in accordance with the present invention, and shows an evaporator 10 for treating an air stream 12 to cool and dehumidify same, thereby generating an over-cooled air stream 14, which is then passed through an air-reheat heat exchanger 16 for re-heating stream 14 to the desired end temperature.

Evaporator 10 and air-reheat heat exchanger 16 are both fed with refrigerant from one or more vapor compression circuits as desired to provide the desired function of cooling and dehumidification in evaporator 10 and re-heating in air-reheat heat exchanger 16. In accordance with the present invention, dehumidification rate is advantageously controlled so as to provide efficient and effective dehumidification, with fewer system starts and stops, which advantageously serves to provide the desired amount of dehumidification while enhancing system reliability and efficiency. This is accomplished by providing a control system in accordance with the present invention which is communicated with sensors for measuring certain system parameters, preferably for measuring one or more of air temperature leaving the evaporator, condensate temperature from the evaporator and low side (e.g. compressor suction) pressure from various stages of the vapor compression system. The control system is adapted to determine dehumidification accomplished by current operating conditions and to adjust the operating condition, either by adding or subtracting stages to the dehumidification function, or by changing operating parameters of certain system components such as compressor and fan speeds, compressor unloading, partial utilization of evaporator coil, etc., or both, so as to provide desired dehumidification in an effective, efficient and reliable rate and manner.

Figure 2:
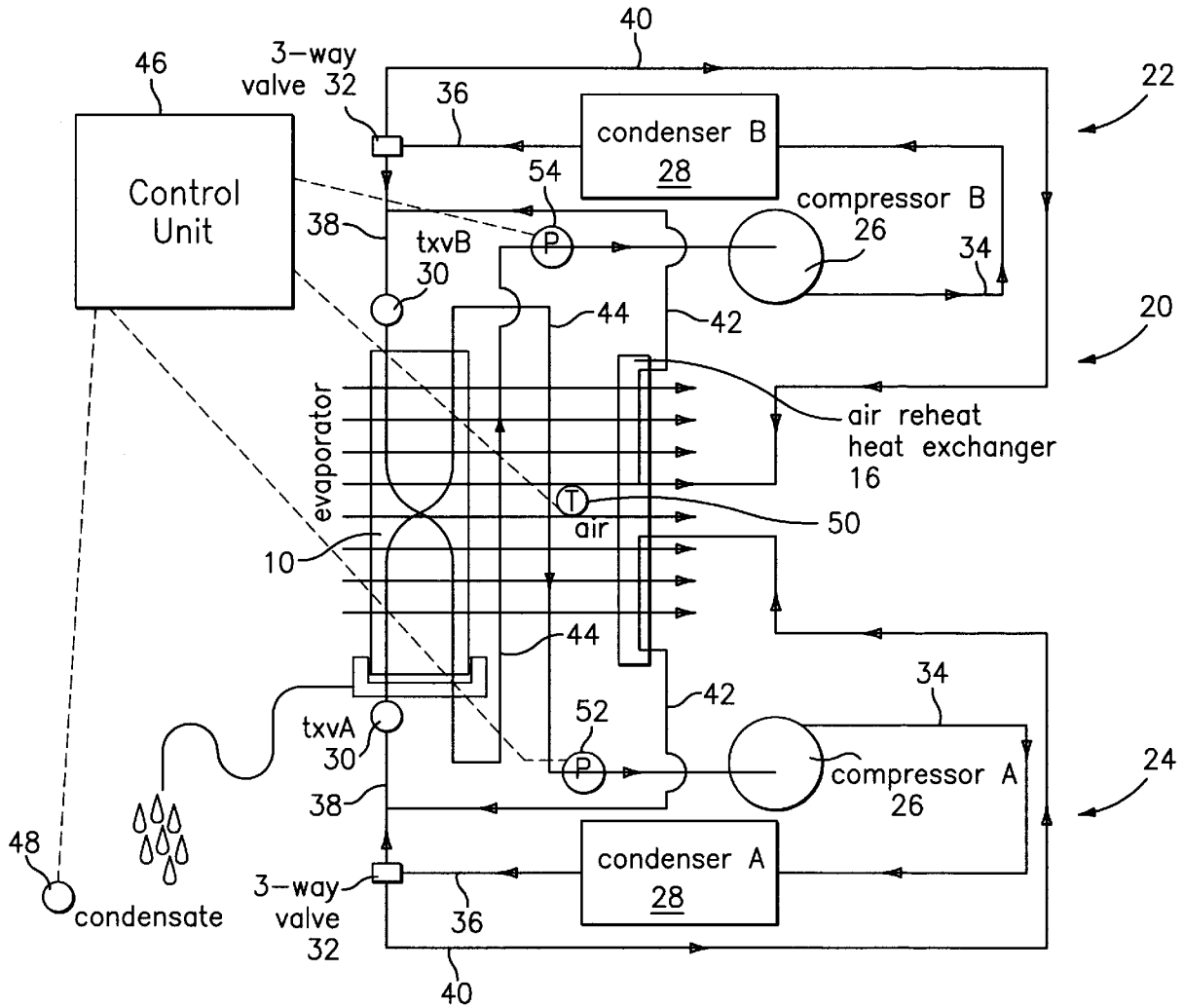
FIG. 2 schematically illustrates one system configuration in accordance with the present invention.

FIG. 2 schematically illustrates one embodiment of a vapor compression system 20 in accordance with the present invention and shows two vapor compression circuits 22, 24 wherein each vapor compression circuit typically includes a compressor 26, a condenser 28 and an expansion device 30, all serially connected by refrigerant lines for conveying refrigerant from component to component.

In accordance with the present invention, each of these plurality of vapor compression circuits is connected to evaporator 10 and also to air-reheat heat exchanger 16, preferably through controllable flow mechanisms such as 3-way valves 32 so that individual vapor compression circuits of the plurality of vapor compression circuits can selectively be communicated with evaporator 10 and air-reheat heat exchanger 16, for example using controllable valves and the like.

Refrigerant fed to evaporator 10 is fed from vapor compressor circuits after the expansion device 30, such that refrigerant entering evaporator 10 is at a cool temperature and provides the desired or necessary cooling and dehumidification of the stream of air.

Still referring to FIG. 2, each vapor compression circuit 22, 24 has refrigerant lines 34 conveying discharge from compressor 26 to condenser 28, refrigerant lines 36 conveying discharge from condenser 28 to 3-way valve 32, refrigerant lines 38 for conveying flow from 3-way valve 32 to evaporator 10, refrigerant lines 40 for conveying flow from 3-way valve 32 to air-reheat heat exchanger 16, refrigerant lines 42 for conveying discharge from air-reheat heat exchanger 16 back to line 38 for feed of evaporator 10, and refrigerant lines 44 for conveying discharge from evaporator 10 back to compressor 26.

Also as shown in FIG. 2, a control unit 46 is advantageously provided and communicated with sensors for sensing condensate temperature 48, air temperature 50 exiting evaporator 10, low side refrigerant pressure 52 and pressure 54 in line 44 exiting evaporator 10.

Control unit 46 is advantageously adapted and programmed to utilize measurements obtained by these sensors to determine current dehumidification rate or capability, and control unit 46 is further advantageously adapted or programmed to take action based upon current dehumidification rate or capability and desired dehumidification and adjust operation of system 20 accordingly.

In one embodiment of the present invention, control unit. 46 is advantageously adapted to determine values corresponding to humidity in the air stream exiting the evaporator at intervals so as to determine whether humidity in the air stream is increasing or decreasing, and to take action for increasing or decreasing dehumidification ability based upon these results.

Figure 3:
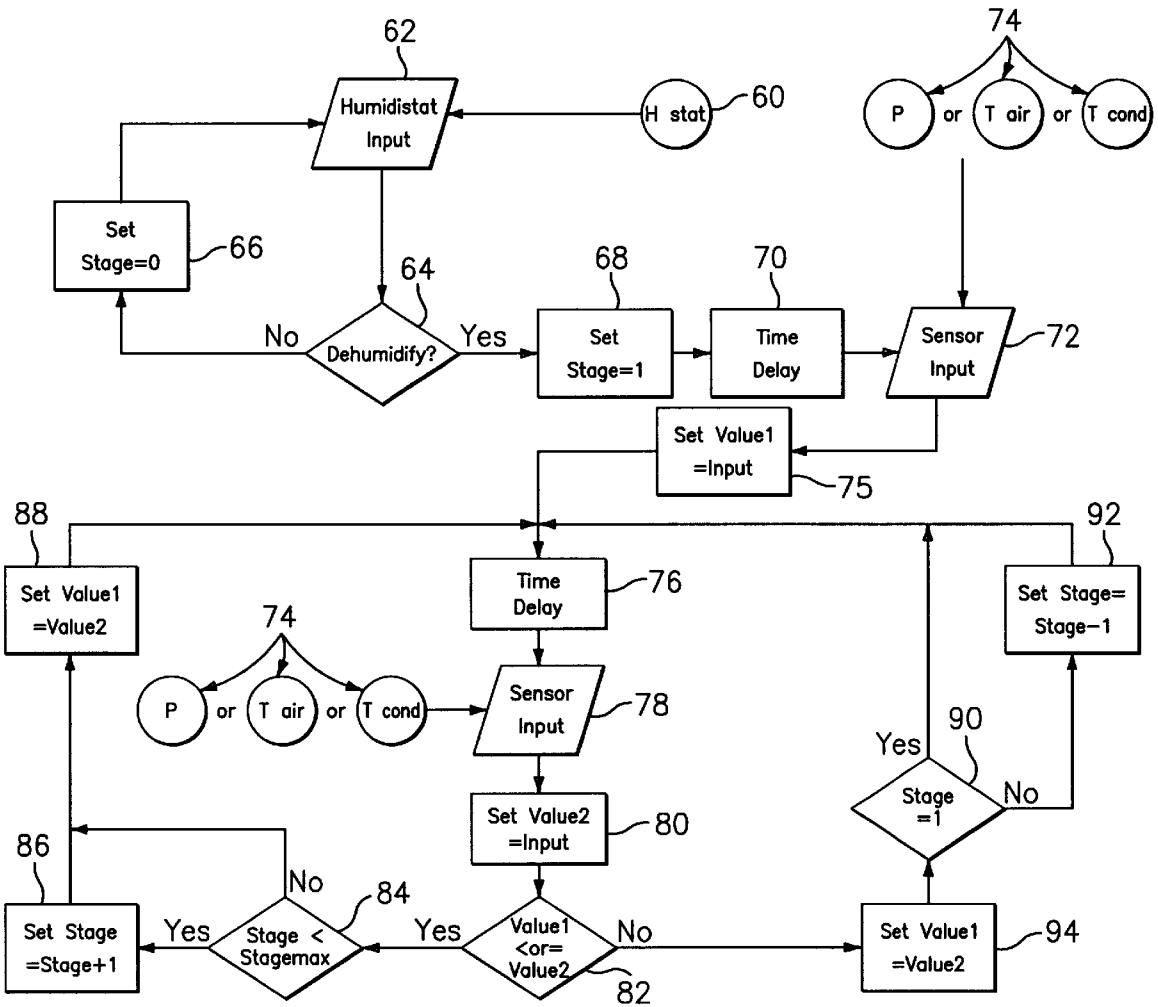
FIG. 3 schematically illustrates operation of a control system for providing desired dehumidification control in accordance with the present invention.

Turning to FIG. 3, operation of control unit 46 in accordance with the present invention is further illustrated.

FIG. 3 schematically shows a humidistat 60 for receiving humidity information from a user of the system, or a controller for the system and the like. Humidistat input 62 is evaluated at step 64 to determine whether dehumidification is necessary. If input 62 indicates that dehumidification is not needed, then dehumidification ability of the system is not activated, in this instance by setting the number of stages to be communicated with the evaporator and air-reheat heat exchanger at zero as shown in step 66. The loop represented by step 62, 64, 66 can continue until such time as step 64 indicates that dehumidification is necessary, at which point dehumidification capability is rendered functional, in this example by setting the number of stages of the multiple circuit system which are connected to the evaporator and air-reheat heat exchanger equal to one as shown in step 68.

After a time delay 70 during which a system in accordance with the present invention is operating so as to dehumidify the stream of air, a sensor input 72 is obtained, for example from low side pressure, air temperature or condensate temperature sensors 74 as shown, and this input is assigned set value 1 as shown in step 75. Following another time delay 76, sensor input 78 is again obtained from sensors 74, and the values obtained from sensor input step 78 are assigned set value 2 as shown in step 80.

In step 82, a determination is made as to whether value 1 is less than or equal to value 2. If value 1, which is a value corresponding directly to humidity level of the air stream exiting the evaporator, is less than or equal to value 2, then humidity in the air stream is either increasing or remaining the same, and additional dehumidification ability is required. Thus, following the "yes" branch off of step 82, assuming that the maximum number of stages available have not been reached (step 84), an additional stage of dehumidification ability is added to the system as shown in step 86 and the value from set value 2 is assigned to set value 1 as shown in step 88.

Returning to step 82, if value 1 is not less than or equal to value 2, then humidity in the air stream exiting the evaporator is in fact decreasing, and assuming that the minimum number of stages connected to the dehumidification ability, that is, one stage, has not been reached (step 90), then the number of active stages can be reduced by one as shown in step 92. In this loop, as well, and as shown in step 94, set value 1 is assigned a value equal to set value 2, and the loop continues back through time delay 76 and obtaining of additional sensor input 78 to determine a new set value 2 as shown in step 80. The lower portion of the flowchart shown in FIG. 3 corresponds to the ability of control unit 46 to determine an appropriate number of stages which are to be functional, or otherwise an appropriate amount of dehumidification ability. At the same time, the loop represented by step 62, 64, 66 continues to run to insure that dehumidification continues to be required. Once dehumidification is no longer required, decision step 64 causes the stages that are active to be set to zero as shown in step 66, and the lower portion of the flowchart representing selection of appropriate number of stages can be stopped from running.

It should be appreciated that FIG. 3 illustrates one method of providing the desired function to control unit 46 in accordance with the present invention. Although this series of steps is particularly preferable, it should be appreciated that other process flowcharts or methods of programming can be incorporated into control unit 46 as desired, so long as the desired function is provided, within the broad scope of the present invention.

Also, it should be understood that the proposed control logic represents one approach for providing the desired function. More complex flowcharts and programming of control unit 46 can involve not just the values of the measured parameters but also the rates at which these parameters are changing, which could be determined by more than two measurements taken at different instants in time, and which rates of change can also be used to determine what amount of dehumidification ability is to be used, for example, to determine the number of circuits to communicate with the dehumidification function.

Refrigerant fed to air-reheat heat exchanger 16 is fed from the vapor compression circuits as warm refrigerant liquid from discharge of the condenser in the embodiment of FIG. 2. Alternatively, hot refrigerant gas from discharge of the compressor can be fed to air-reheat heat exchanger 16 instead. Further, air-reheat heat exchanger 16 and the condenser can be connected in series or in parallel manner.

In accordance with the present invention, and as set forth above, it has been found that current system dehumidification ability, or latent capacity for removal of moisture, can be determined by providing sensors to measure one or more aspects of current system conditions, and this information can be used to control the system and provide desired humidity levels. Typically, vapor compression systems are provided with a humidistat for entering a requirement for dehumidification, typically in the form of a digital input.

In accordance with the present invention, current system dehumidification ability can be detected by placing one or more sensors in one or more various locations. For example, sensors can be placed to detect temperature of condensate from the evaporator by being placed in the condensate pan of the evaporator coil, or to detect air temperature leaving the evaporator as illustrated in FIG. 1 by being placed after the evaporator coil but before the air-reheat coil.

This provides means for sensing the system ability as well as current rate of moisture removal. In addition, suction pressure/temperature transducers can be used for the same purpose. The measurements obtained using these sensors can be used to calculate air temperature leaving the evaporator which is directly related to the system dehumidification ability. As air temperature leaving the evaporator decreases, the ability to dehumidify increases. Thus, in accordance with the present invention, by monitoring one of the parameters mentioned above, the direct relationship with air temperature leaving the evaporator can be established and the current and required rate of dehumidification can be estimated. In accordance with the present invention, if more latent capacity is required, one or more additional vapor compression circuits which are connected to evaporator 10 and air-reheat exchanger 16 can be communicated, turned on or activated. As the latent load decreases, one or more of these vapor compression circuits connected with evaporator 10 and air-reheat heat exchanger 16 can be shut down. Further, other means of control, such as compressor and fan speed, compressor unloading, partial utilization of the evaporator coil, etc., can be employed for the same purpose. It should readily be appreciated that using this system, the current system dehumidification ability can be adjusted to provide dehumidification sufficient to reach a desired level, and furthermore to provide such dehumidification in an efficient, precise and reliable manner. This is in contrast to existing dehumidification, wherein dehumidification control is typically only grossly manageable, and in some occasions, cooling rate may need to be slowed to extend operation of the vapor compression system for a longer period of time to allow for sufficient dehumidification. Additionally, the number of start/stop cycles can be greatly reduced, enhancing system reliability and efficiency.

In accordance with the present invention, the foregoing functions can be carried out by a control system which may be provided as a processor unit such as a personal computer, memory chip or the like. This function is typically provided by on-board capability, connected to the vapor compression system, but may be provided in a different manner as well. The processor unit is advantageously communicated with an input such as a humidistat for entering desired humidity level, and is furthermore adapted to determine a required system dehumidification ability sufficient to reach the desired temperature, and compare this required system dehumidification ability with current system dehumidification ability. Finally, the processor unit in accordance with the present invention is advantageously programmed and adapted to operate various control mechanisms to selectively connect or disconnect one or more of the plurality of vapor compression circuits to the evaporator and air-reheat heat exchanger as desired, and/or to operator other control means as mentioned above.

Figure 4:
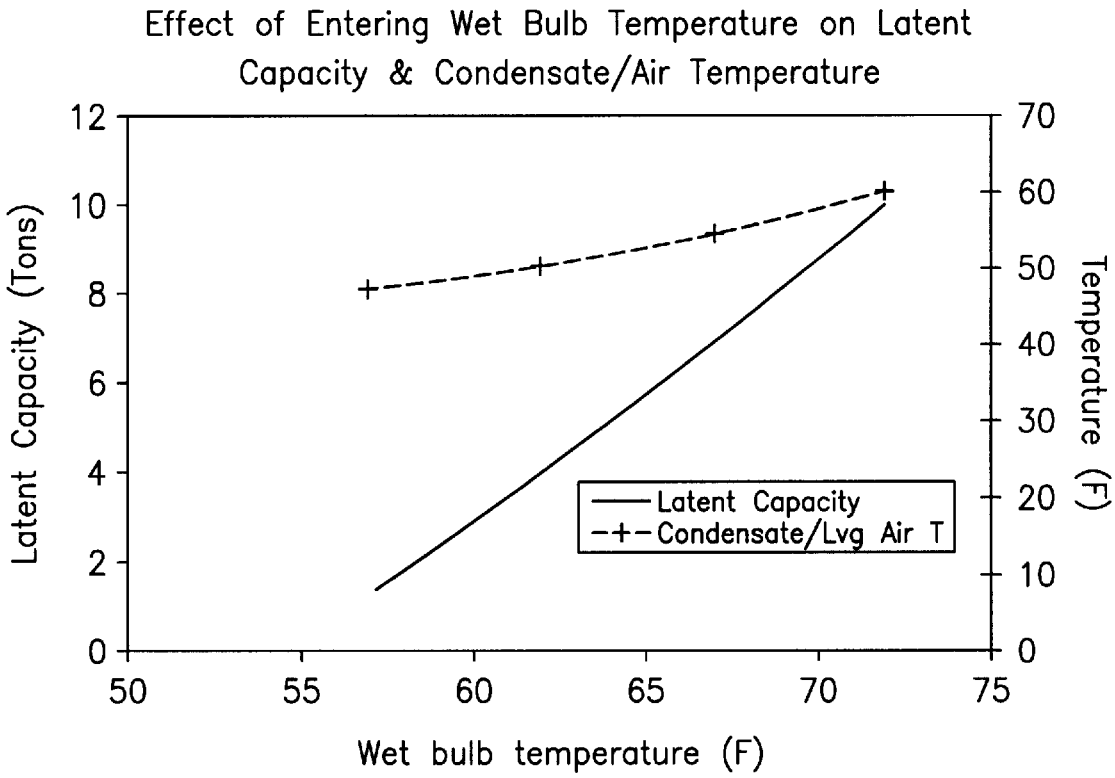
FIG. 4 conceptually illustrates the relationship between entering wet bulb temperature and latent capacity and condensate/air temperature which relationship is used to determine current system dehumidification ability in accordance with the present invention.

Turning to FIG. 4, this graphical representation demonstrates the principal conceptual relationship between condensate temperature/air leaving evaporator temperature, and latent capacity. Sufficient definition exists that a change in wet bulb temperature can reliably be sensed and used as a control input. Although sensors can be positioned in a variety of locations to determine the required information, sensing of the condensate temperature, air temperature leaving the evaporator and entering air-reheat heat exchanger or compressor suction pressure are particularly preferred methods for determining current system dehumidification ability.

It should of course be appreciated that the present system and method advantageously provide for multi-stage control of dehumidification which is a substantial improvement over the gross humidity control which is provided by existing systems, and that the multi-stage dehumidification control advantageously provides for more efficient and reliable system operation and more effective humidity control, all as desired.

It should be understood that the evaporator and/or air-reheat heat exchanger may be constructed from a number of separate units each connected to a separate refrigeration circuit.

It should also be noted that additional steps of humidity adjustment can be provided by variation of operating parameters such as compressor speed, indoor fan speed, compressor unloading, partial utilization of evaporator coil, etc., if such capability are incorporated into the system configuration.

It should also be appreciated that the hot gas reheat system configuration schematic represents one of several possible scenarios with the evaporator and air-reheat heat exchanger being connected in parallel. Another arrangement within the scope of the invention would be to connect them in series.

In an embodiment wherein refrigerant is fed to the air-reheat heat exchanger as hot gas discharged from the compressor, the condenser and air-reheat heat exchanger can be connected in parallel or in series as desired.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A vapor compression system, comprising:

at least one vapor compression circuit including a compressor, a condenser, and an expansion device;

an evaporator for receiving refrigerant from said vapor compression circuit and adapted to provide a cooled stream of air;

an air-reheat heat exchanger positioned to receive said cooled stream of air and communicated with at least one of liquid discharged from said condenser and gas discharged from said compressor for reheating said cooled stream of air to a desired temperature;

wherein said at least one vapor compression circuit, said evaporator and said air reheat heat exchanger are operable to provide a range of selectable dehumidification rates; and a control system adapted to receive input related to a desired humidity and current humidity-related data and to select an appropriate dehumidification rate from said range based upon said input and said data, wherein said at least one vapor compression circuit comprises a plurality of vapor compression circuits, which are selectively communicable with said evaporator and said air-reheat heat exchanger, and wherein said control system is adapted to communicate a number of said plurality of vapor compression circuits with said evaporator and said air-reheat heat exchanger which is sufficient to provide said cooled stream of air with a humidity corresponding to said input.

2. The system of claim 1, wherein said control system is further adapted to provide humidity removal at a desired rate.

3. The system of claim 1, wherein said range of selectable dehumidification rates corresponds to operation of said system with different numbers of said plurality of vapor compression circuits communicated with said evaporator and said air-reheat heat exchanger.

4. The system of claim 1, wherein said control system has a first loop adapted to determine whether dehumidification is desired and a second loop adapted to determine said number of said plurality of vapor compression circuits to communicate with said evaporator and said air-reheat heat exchanger.

5. The system of claim 1, wherein at least one of said vapor compression system, said evaporator and said air-reheat heat exchanger is operable at varying capacities corresponding to said range of selectable dehumidification rates.

6. The system of claim 1, further comprising means for determining said current humidity-related data.

7. The system of claim 6, wherein said means for determining said current humidity-related data comprises at least one sensor positioned to determine evaporator saturation temperature.

8. A method for operating a vapor compression system, comprising the steps of:

providing at least one vapor compression circuit including a compressor, a condenser and an expansion device;

connecting said at least one vapor compression circuit to an evaporator and an air-reheat heat exchanger so as to provide a range of selectable dehumidification rates for a stream of air passing through said evaporator and said air-reheat heat exchanger;

receiving a desired humidity setting;

determining an appropriate system dehumidification rate for meeting said desired humidity setting; and adjusting said vapor compression system to provide said appropriate system dehumidification rate, wherein said at least one vapor compression circuit comprises a plurality of vapor compression circuits which are selectively communicable with said evaporator and said air-reheat heat exchanger, wherein said determining step comprises determining an appropriate number of said plurality of vapor compression circuits to communicate with said evaporator and said air-reheat heat exchanger, and wherein said adjusting step comprises communicating said appropriate number of vapor compression circuits with said air-reheat heat exchanger.

9. The method of claim 8, further comprising the step of continuously evaluating said desired humidity setting to determine whether dehumidification is desired.

10. A method for operating a vapor compression system, comprising the steps of:

providing at least one vapor compression circuit including a compressor, a condenser and an expansion device;

connecting said at least one vapor compression circuit to an evaporator and an air-reheat heat exchanger so as to provide a range of selectable dehumidification rates for a stream of air passing through said evaporator and said air-reheat heat exchanger;

receiving a desired humidity setting;

determining an appropriate system dehumidification rate for meeting said desired humidity setting; and adjusting said vapor compression system to provide said appropriate system dehumidification rate, wherein said determining step comprises determining a first value of humidity-related data, determining a second value of humidity-related data later in time than said first value, comparing said second value to said first value to determine a current system dehumidification rate, and adjusting said vapor compression system based upon said current system dehumidification rate.

* * * * *